US010422495B1

(12) United States Patent
Mitchell, Jr.

(10) Patent No.: US 10,422,495 B1
(45) **Date of Patent: *Sep. 24, 2019**

(54) FLAME LAMP

(71) Applicant: Feit Electric Company, Inc., Pico Rivera, CA (US)

(72) Inventor: John D. Mitchell, Jr., Andover, MA (US)

(73) Assignee: Feit Electric Company, Inc., Pico Rivera, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,544

(22) Filed: May 14, 2019

Related U.S. Application Data

(63) Continuation of application No. 15/966,111, filed on Apr. 30, 2018, now Pat. No. 10,344,930.

(51) Int. Cl.

| | |
|---|---|
| ***F21K 9/60*** | (2016.01) |
| ***F21S 10/04*** | (2006.01) |
| ***F21V 23/00*** | (2015.01) |
| *F21Y 115/10* | (2016.01) |
| *F21Y 105/16* | (2016.01) |

(52) U.S. Cl.
CPC ..... *F21S 10/043* (2013.01); *F21K 9/60* (2016.08); *F21V 23/005* (2013.01); *F21Y 2105/16* (2016.08); *F21Y 2115/10* (2016.08)

(58) Field of Classification Search
CPC ..... F21S 10/043; F21S 10/04; F21K 9/60; F21V 23/005
See application file for complete search history.

(56) References Cited

U.S. PATENT DOCUMENTS

| | | | | |
|---|---|---|---|---|
| 7,682,036 | B2 * | 3/2010 | Reiff | F21L 4/04 362/184 |
| 7,748,876 | B2 * | 7/2010 | Zhang | F21K 9/00 165/104.33 |
| 7,784,971 | B2 * | 8/2010 | Dorogi | F21V 29/004 362/294 |
| 8,764,247 | B2 * | 7/2014 | Pattekar | F21V 29/83 362/294 |
| 9,689,544 | B2 * | 6/2017 | Green, Jr. | F21S 10/043 |
| 9,890,938 | B2 * | 2/2018 | Zhang | F21V 21/06 |
| 2011/0163683 | A1 * | 7/2011 | Steele | F21V 23/02 315/192 |
| 2012/0268936 | A1 * | 10/2012 | Pickard | F21K 9/90 362/249.02 |
| 2015/0267902 | A1 * | 9/2015 | Zhang | F21L 4/04 362/188 |
| 2016/0018097 | A1 * | 1/2016 | Alexiou | F21V 29/75 362/249.02 |

* cited by examiner

*Primary Examiner* — Anabel Ton
(74) *Attorney, Agent, or Firm* — Alston & Bird LLP

(57) ABSTRACT

A flame lamp comprises a light module. An example light module comprises a circuit board having a first side and a second side and defining a module axis; and a plurality of light emitting diode (LED) packages. At least one LED package is mounted to each of the first and second side of the circuit board. The example light module further comprises an optical sleeve. The circuit board is mounted within the optical sleeve. The optical sleeve comprises a plurality of optical columns each having a light emitting surface. Each light emitting surface has a profile such that one or more profiles of one or more light emitting surfaces define an ellipse in a cross-section of the light module taken perpendicular to the module axis.

20 Claims, 12 Drawing Sheets

FLAME LAMP

CROSS-REFERENCE TO RELATED APPLICATIONS

This application is a continuation of U.S. application Ser. No. 15/966,111, filed Apr. 30, 2018, the content of which is incorporated herein by reference in its entirety.

BACKGROUND

Traditionally, lamps using light emitting diodes (LEDs) that were designed to simulate the appearance of a flame used a soft printed circuit board (PCB) that was curled into a cylinder. However, the production costs of such lamps are quite high and the production art is such that production of such lamps is not scalable to mass production.

Therefore, there is a need in the art for lamps that can simulate the appearance of a flame but that may be produced at a reasonable cost and that is produced via scalable means.

BRIEF SUMMARY

Embodiments of the present invention provide a flame lamp and/or a light module configured to provide a lighting effect that simulates the appearance of a flame. For example, in an example embodiment, the flame lamp may be configured to provide light at 360° around the flame lamp and the provided light may flicker as if provided via a flame. In an example embodiment, the flame lamp comprises an envelope, a light module, and a base assembly. In an example embodiment, the light module comprises a circuit board having at least one LED package mounted to each side of the circuit board and an optical sleeve about the circuit board. In an example embodiment, the optical sleeve comprises a plurality of optical columns that have light emitting surfaces configured to cause light emitted by the light module to be emitted approximately 360° around the module axis defined by the circuit board and/or the optical sleeve. For example, in an example embodiment, in a cross-section that is perpendicular to the module axis, the light emitting surfaces of the optical columns define an ellipse. In an example embodiment, the ellipse is a circle. In an example embodiment, driver circuitry is mounted to the circuit board. In an example embodiment, the driver circuitry comprises a processing element programmed to cause the LED packages to be provided with pulsed signals that cause the LED packages to turn on and off and/or brighten and dim to provide a flickering effect that simulates the flickering of a flame. For example, in an example embodiment, the processing element may be programmed to cause the driver circuitry to provide pulsed signals to the LED packages in accordance with a programmed pattern that causes the light emitted by the light module to be simulate the flickering of a flame.

In accordance with one aspect of the present invention, a light module is provided. In an example embodiment, the light module comprises a circuit board having a first side and a second side and defining a module axis; and a plurality of light emitting diode (LED) packages. A first LED package of the plurality of LED packages is mounted to the first side of the circuit board and a second LED package of the plurality of LED packages is mounted to the second side of the circuit board. The light module further comprises an optical sleeve having an exterior and an interior. The circuit board is mounted within the interior of the optical sleeve. The optical sleeve comprises a plurality of optical columns each having a light emitting surface. Each light emitting surface has a profile such that one or more profiles of one or more light emitting surfaces define an ellipse in a cross-section of the light module taken perpendicular to the module axis.

In accordance with another aspect of the present invention, a flame lamp is provided. In an example embodiment, a flame lamp is a lamp that is configured to provide light that flickers such that the flickering of the light simulates the flickering of a flame. In an example embodiment, the flame lamp comprises a light module. The light module comprises a circuit board having a first side and a second side and defining a module axis; and a plurality of light emitting diode (LED) packages. A first LED package of the plurality of LED packages is mounted to the first side of the circuit board and a second LED package of the plurality of LED packages is mounted to the second side of the circuit board. The light module further comprises an optical sleeve having an exterior and an interior. The circuit board is mounted within the interior of the optical sleeve. The optical sleeve comprises a plurality of optical columns each having a light emitting surface. Each light emitting surface has a profile such that one or more profiles of one or more light emitting surfaces define an ellipse in a cross-section of the light module taken perpendicular to the module axis. The flame lamp further comprises an envelope and a base assembly. The light module is mounted and enclosed within the envelope and the base assembly.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 3A:
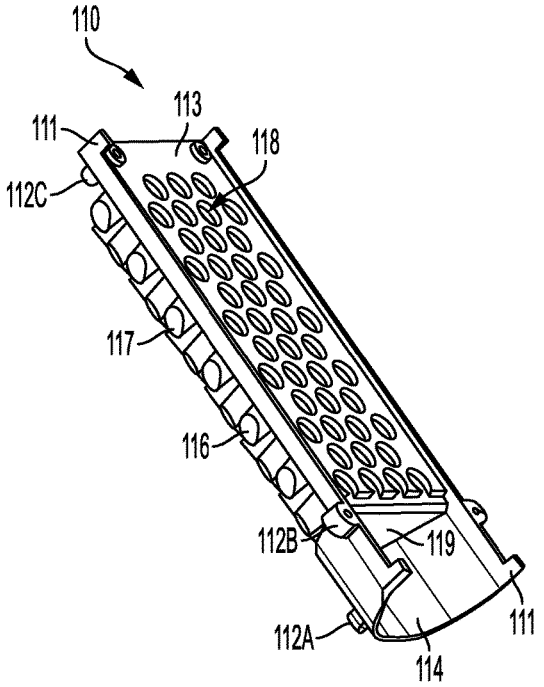
Figure 3B:
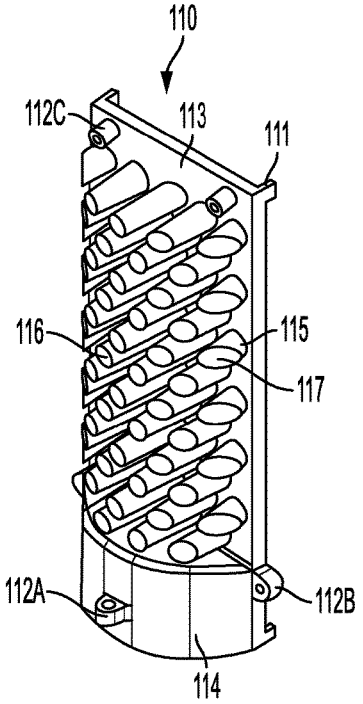
Figure 4A:
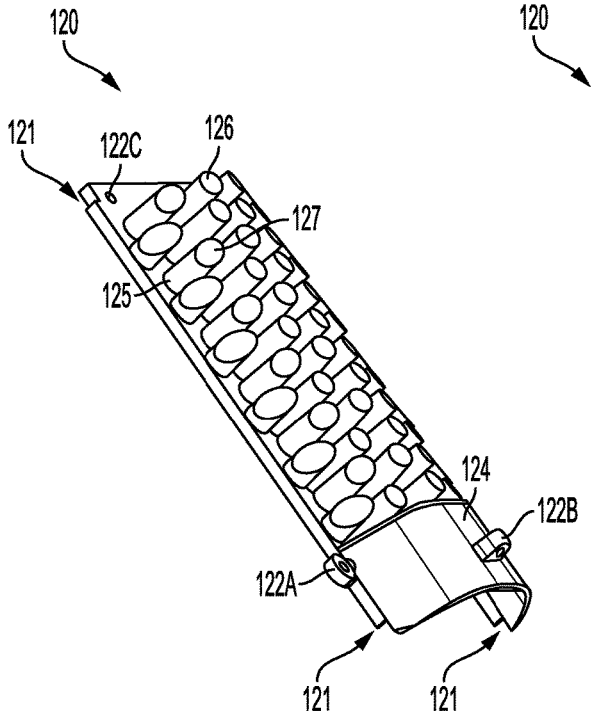
Figure 4B:
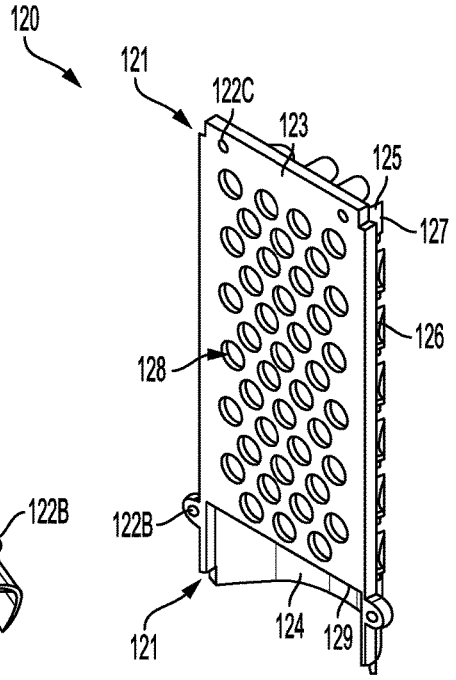
Figures 5A, 5B, 5C:
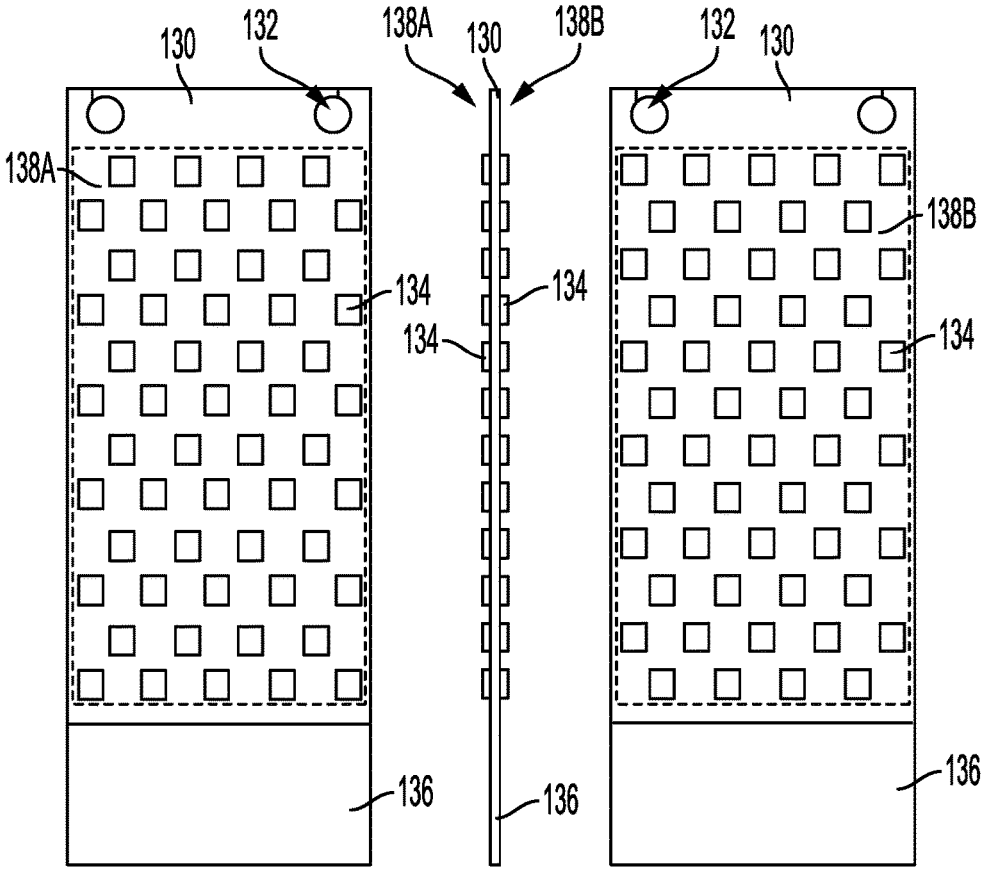
Figure 6:
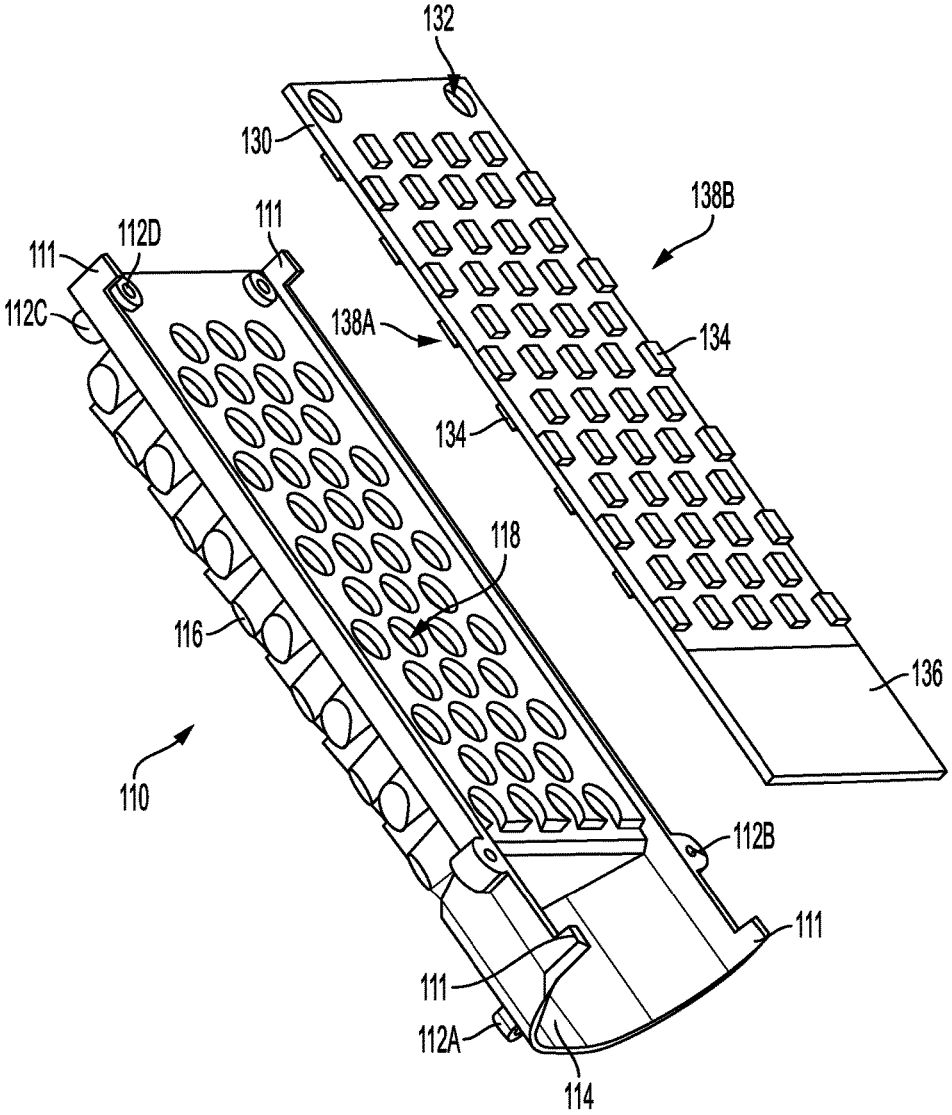
Figure 7:
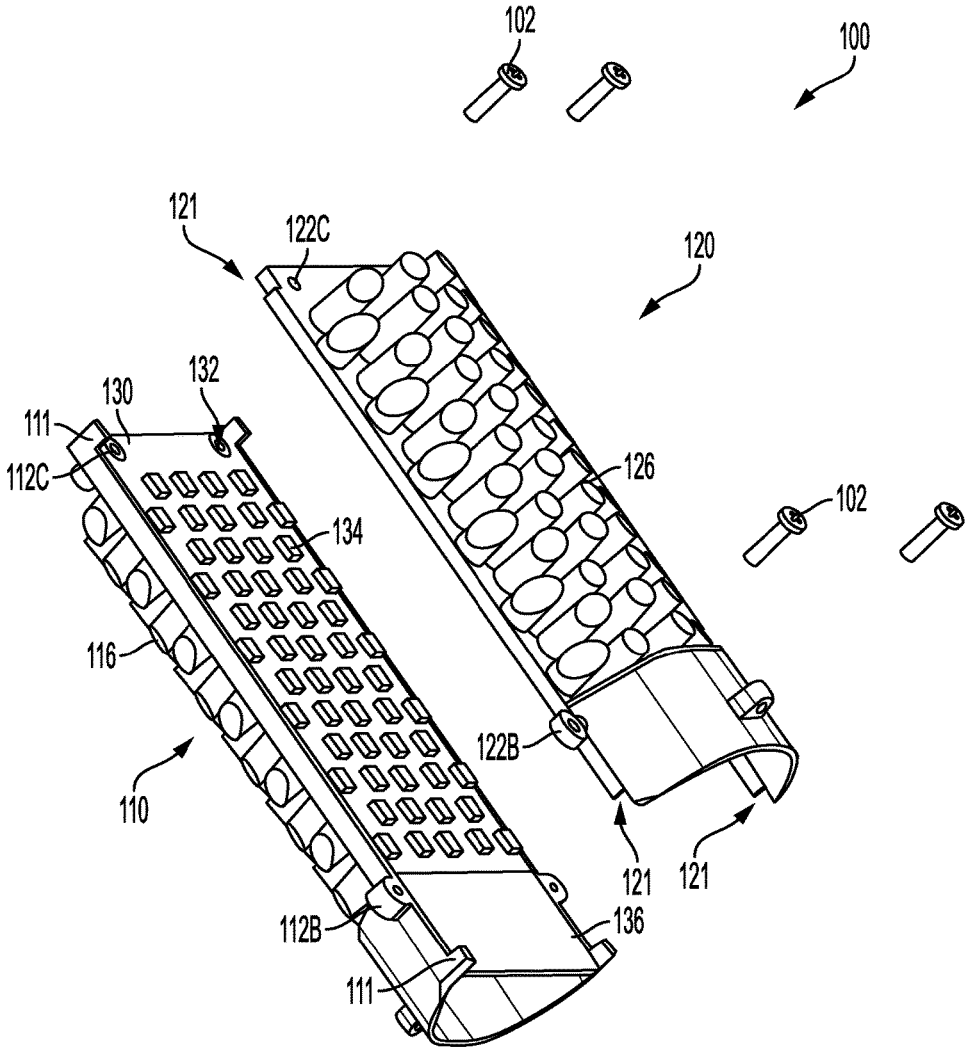
Figure 8:
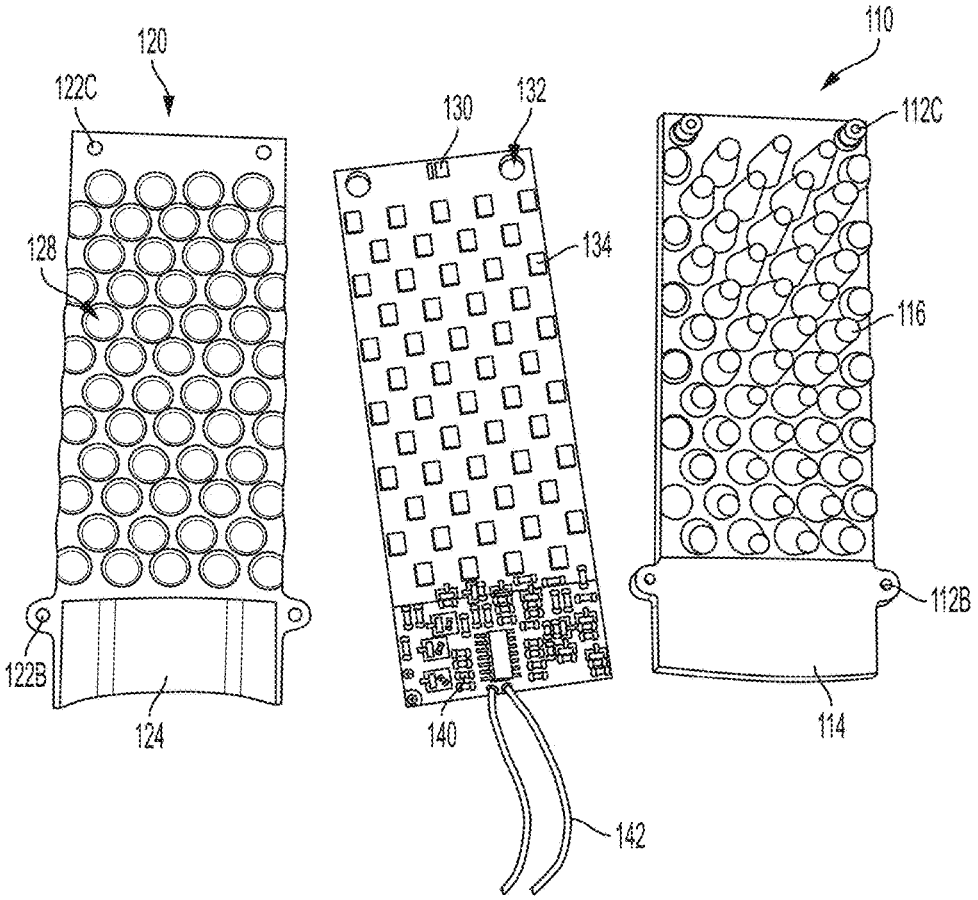
Figure 9:
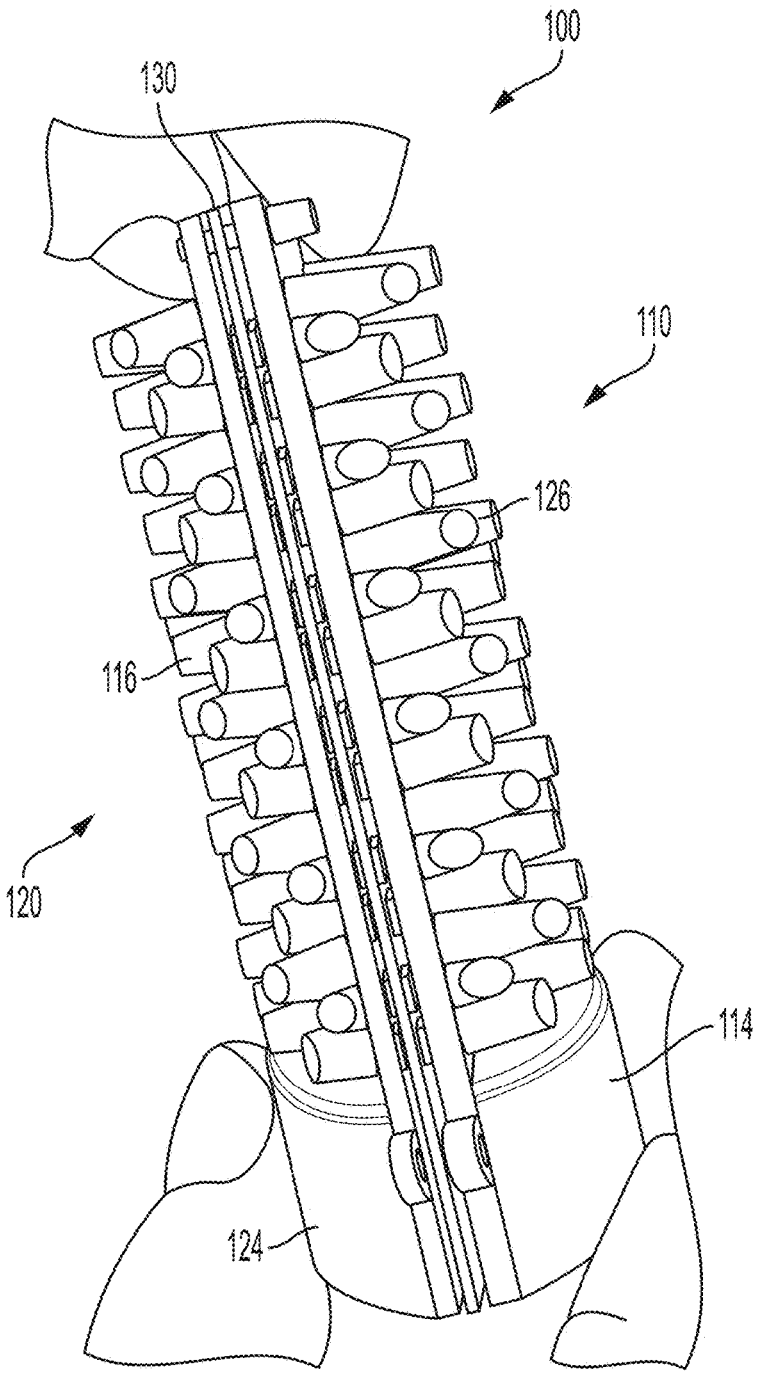
Figure 10:
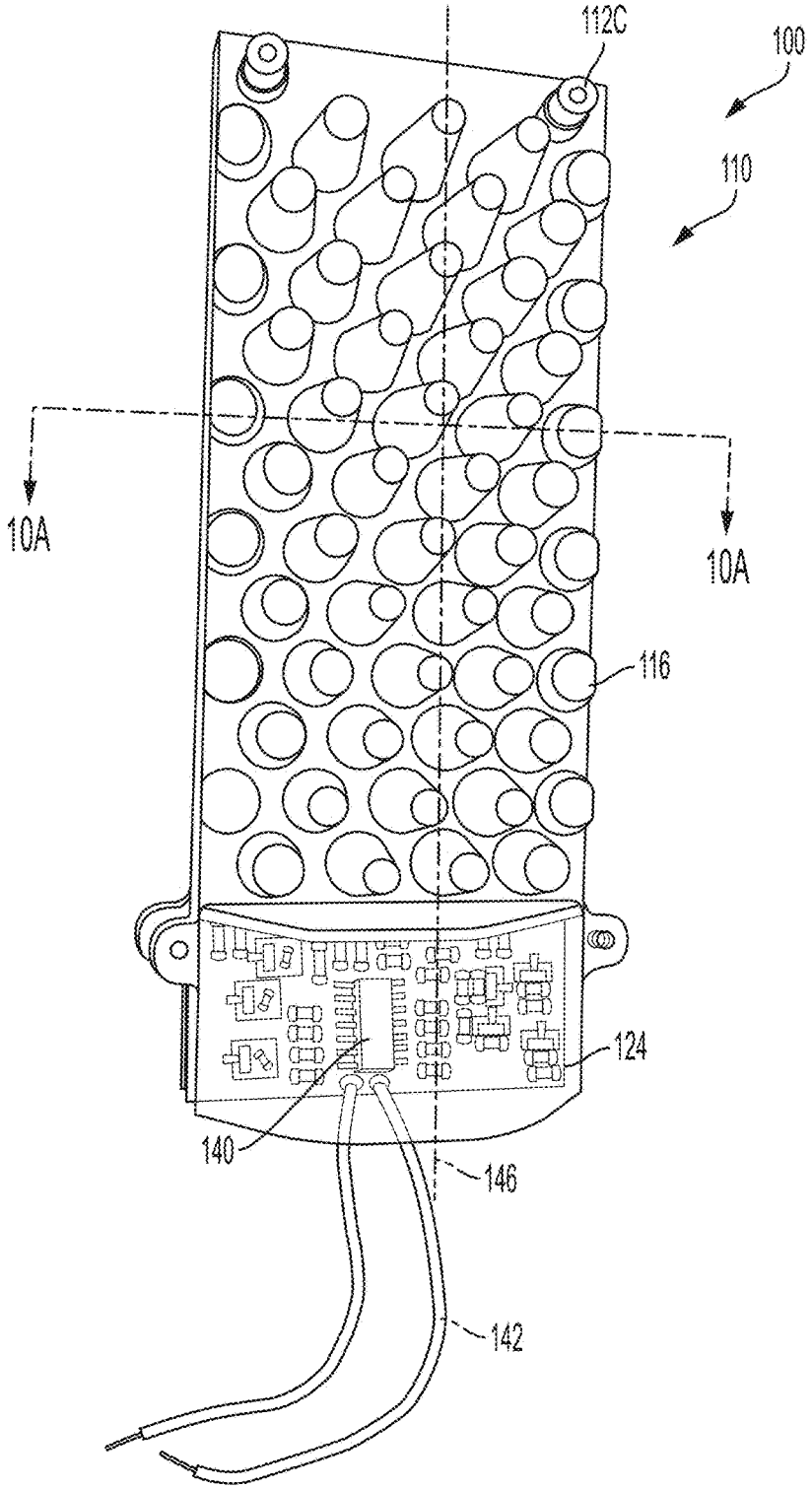
Figure 10A:
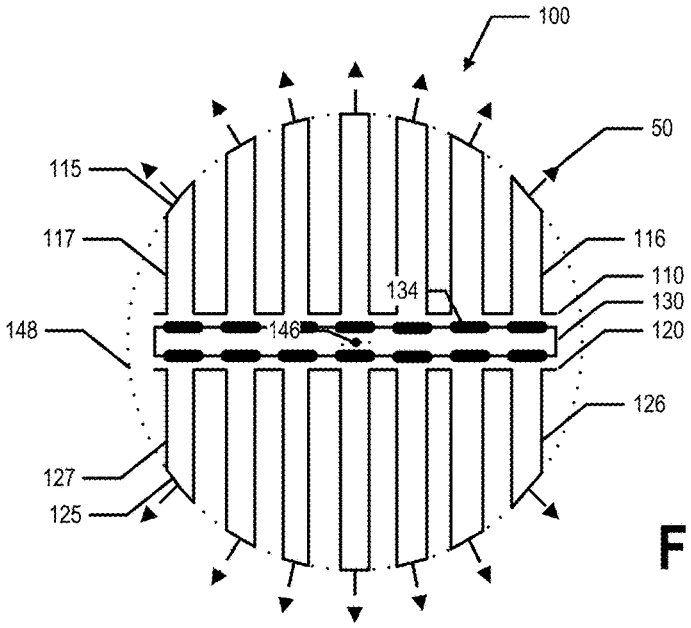
Figure 11:
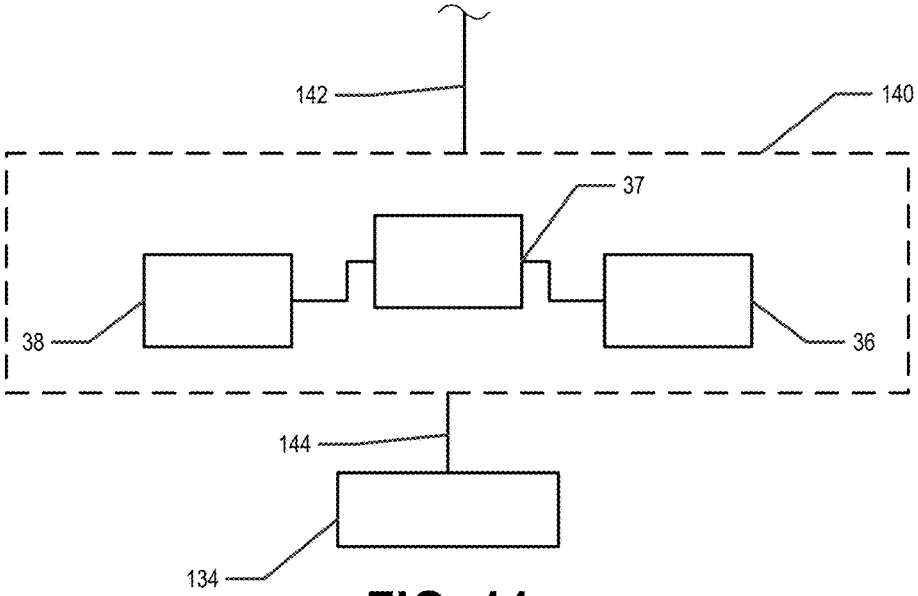
Figure 12:
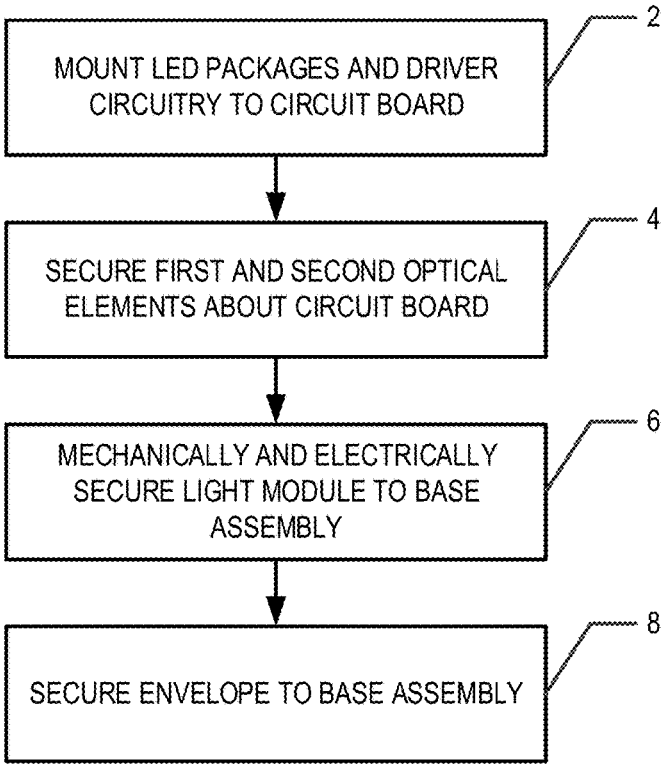

FIGS. 3A and 3B each provide a perspective view of a first optical element, in accordance with an example embodiment of the present invention;

FIGS. 4A and 4B each provide a perspective view of a second optical element, in accordance with an example embodiment of the present invention;

FIGS. 5A, 5B and 5BC provide a first side view, an edge-on view, and a second side view of a circuit board, in accordance with an example embodiment of the present invention;

FIG. 6 illustrates a circuit board being placed one a first optical element, in accordance with an example embodiment of the present invention;

FIG. 7 illustrates a second optical element being placed on a circuit board and first optical element, in accordance with an example embodiment of the present invention;

FIG. 8 provides an exploded view of a light module, in accordance with an example embodiments of the present invention;

FIG. 9 provides an edge-on view of a light module, in accordance with an example embodiment of the present invention;

FIG. 10 provides a perspective view of a light module, in accordance with an example embodiment of the present invention;

FIG. 10A illustrates a cross-section of the light module shown in FIG. 10, in accordance with an example embodiment of the present invention;

FIG. 11 provides a block diagram of driver circuitry of a light module, in accordance with an example embodiment of the present invention; and FIG. 12 provides a flowchart illustrating example processes, procedures, and/or operations for manufacturing a flame lamp, in accordance with an example embodiment of the present invention.

DETAILED DESCRIPTION OF VARIOUS EMBODIMENTS

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. The term "or" (also denoted "/") is used herein in both the alternative and conjunctive sense, unless otherwise indicated. The terms "illustrative" and "exemplary" are used to be examples with no indication of quality level. The term "approximately" refers to within engineering and/or manufacturing limits. Like numbers refer to like elements throughout.

Figure 1:
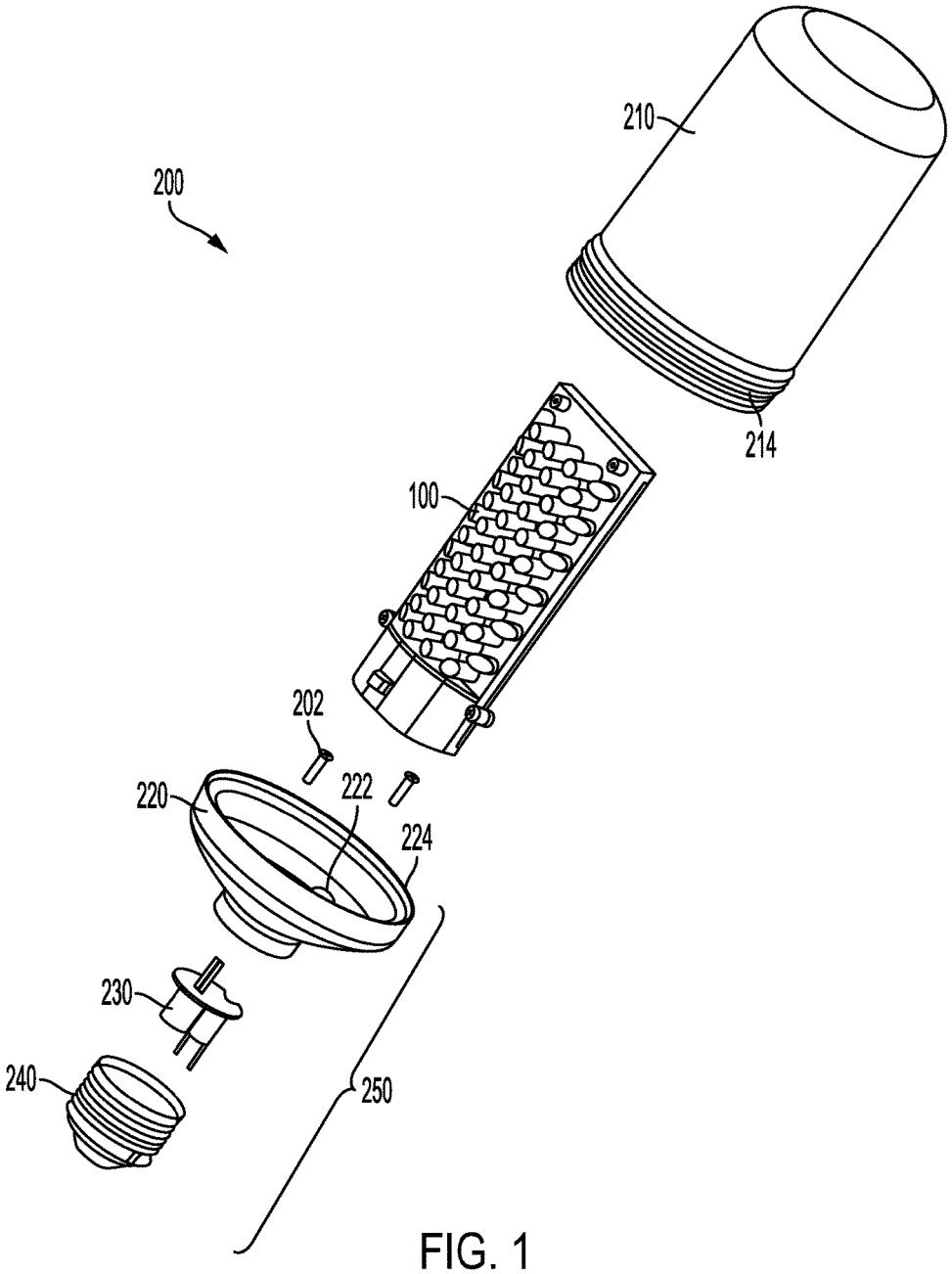
FIG. 1 is an exploded view of a flame lamp, in accordance with an example embodiment of the present invention.

Example embodiments of the present invention provide a flame lamp configured to provide light that simulates light emitted by a flame. In an example embodiment, the flame lamp is configured to emit a flickering light that simulates the flickering light emitted by a flame. FIG. 1 provides an exploded view of an example embodiment of a flame lamp 200. In an example embodiment, a flame lamp 200 comprises an envelope 210, a light module 100, and a base assembly 250.

In various embodiments, the envelope 210 may be made of plastic, glass, and/or another translucent, transparent, semi-transparent, and/or semi-translucent material. In an example embodiment, the envelope 210 may be shaped as a cylindrical, flame, A-series, B-series, C-series, CA-series, S-series, F-series, or other shape envelope. In various embodiments, the envelope 210 and the base assembly 250 are configured to enclose the light module 100 therein. For example, the envelope 210 is configured to be secured to the base assembly such that the light module 100 is housed and enclosed within the interior of the space defined by the envelope 210 and the base assembly 250. For example, in an example embodiment, the envelope 210 comprises threads 214 for securing the envelope 210 to the corresponding threads 224 of the base assembly 250. As should be understood, various techniques may be used for securing the envelope 210 to the base assembly 250 in various embodiments.

Figure 2:
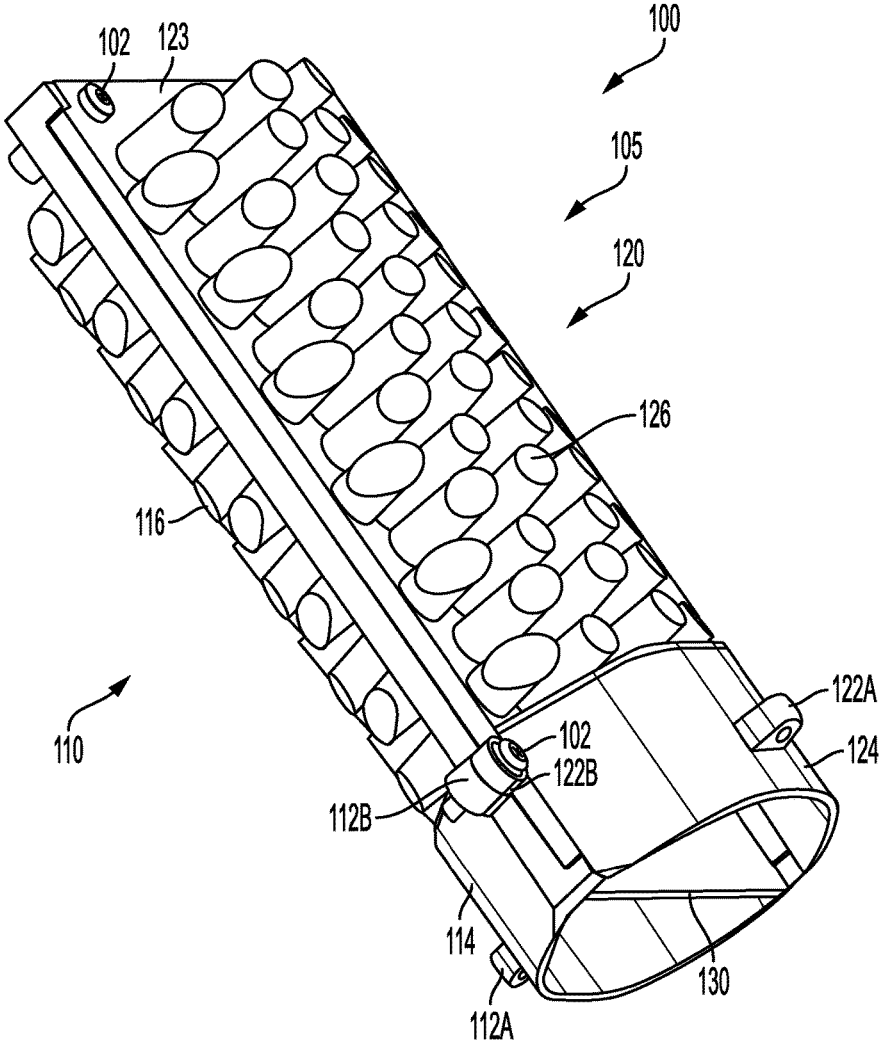
FIG. 2 is a perspective view of a light module, in accordance with an example embodiment of the present invention.

In various embodiments, the base assembly 250 comprises a base housing 220, a connection facilitator 230, and a base cap 240. For example, the base cap 240 may be configured to be rotated and/or otherwise mechanically secured into a light socket to place the flame lamp 200 in electrical connection with line voltage and/or a power source. For example, the base cap 240 may be an A15, A19, A21, A22, B8, B10, C7, C9, C11, C15, F10, F15, F20 and/or other traditional/standard lamp size base, in various embodiments. In an example embodiment, the connection facilitator 230 may be configured to be mechanically secured in electrical connection with electrical contacts of the base cap 240 and to have the electrical leads 142 of the light module 100 (see FIG. 10) mechanically secured thereto to place the base cap 240 in electrical communication with the driver circuitry 140 of the light module 100. In an example embodiment, the base housing 220 is configured to have the light module 100, connection facilitator 230, and/or the like mounted therein and the base cap 240 mounted thereto. For example, the light module 100 may be secured into the base housing 220 via fastener receivers 222. For example, the fasteners 202 may pass through the first engagement elements 112A, 112B of the optical sleeve 105 (see FIG. 2) and be received and/or secured within the fastener receivers 222 to secure the light module 100 within the base housing 220.

In an example embodiment, the base assembly 250 may comprise a power supply compartment in addition to and/or in place of the base cap 240. For example, in an example embodiment, the base assembly 250 may comprise a power supply compartment configured to receive a power supply (e.g., one or more batteries) therein such that the power supply may be used to provide electrical power to the driver circuitry 140 and the LED packages 134 (see FIG. 8). For example, in an example embodiment, the flame lamp 200 may be configured to be operated using a mobile power supply (e.g., one or more batteries).

In various embodiments, the flame lamp 200 further comprises a light module 100. In various embodiments, the light module 100 may be secured within the interior of the flame lamp 200 defined by the envelope 210 and the base assembly 250. FIGS. 2, 3A, 3B, 4A, 4B, 5A, 5B, 5C, 6, 7, 8, 9, 10, and 10A provide various views of a light module 100 and/or portions thereof, according to various embodiments. In an example embodiment, the light module comprises a double-sided circuit board 130. In various embodiments, the circuit board 130 is a double-sided PCB, an aluminum board, and/or the like. For example, the circuit board 130 may be a rigid double-sided PCB. At least one LED package 134 is mounted to each side of the circuit board 130. In various embodiments, a plurality of LED packages 134 are mounted to each side of the circuit board 130. The circuit board 130 is enclosed within an optical sleeve 105. In an example embodiment, the optical sleeve 105 is configured to condition the light emitted by the LED packages 134 mounted to a planar circuit board 130 such that light is emitted by the light module 100 at approximately 360° about a characteristic axis of the light module 100 (e.g., the module axis 146). The optical sleeve 105 comprises a plurality of optical columns 116, 126. The optical columns 116, 126 each comprise a column surface 117, 127 and a light emitting surface 115, 125. In various embodiments, the light emitting surfaces 115, 125 are slanted, curved, and/or at angle with respect to the corresponding column surface 117, 127 such that the light emitting surfaces 115, 125 define an ellipse. For example, the light emitting surfaces 115, 125 may define an elliptical cylinder about the light module 100. In an example embodiment, the light emitting surfaces define a circular cylinder about the light module 100. In various embodiments, driver circuitry 140 is mounted to a driver portion 136 of the circuit board 130. Various components of the light module 100 will now be described in more detail.

Exemplary Circuit Board

In various embodiments, the light module 100 comprises a circuit board 130. In various embodiments, the circuit board 130 may be a rigid circuit board 130 such as a rigid PCB, aluminum board, and/or the like. In the illustrated example embodiment, the circuit board 130 is rectangular in shape, though various other shapes are the circuit board 130 are contemplated. In various embodiments, the circuit board 130 comprises a first side 138A and a second side 138B. The first side 138A and the second side 138B are both approximately planar and/or flat. For example, the circuit board 130 may be approximately planar and/or flat. One or more LED packages 134 may be mounted to each side (e.g., first side 138A and second side 138B) of the circuit board 130. The circuit board may further comprise a driver region 136. Components of the driver circuitry 140 may be mounted to the circuit board 130 within the driver region 136. In an example embodiment, components of the driver circuitry 140 may be mounted to the first side 138A and the second side 138B of the circuit board 130 within the driver region 136.

In various embodiments, the circuit board 130 defines a module axis 146. In various embodiments, the module axis passes through the center of the circuit board 130 along a major axis of the circuit board 130. For example, when the circuit board 130 is rectangular shaped, with a length of the circuit board 130 that is greater than the width of the circuit board 130, the module axis 130 may be parallel to the length of the circuit board 130 and pass through the center of the circuit board 130, as shown in FIGS. 10 and 10A.

In various embodiments, the circuit board 130 may be configured to be secured to and/or within the optical sleeve 105. For example, in an example embodiment, the circuit board 130 comprises guide holes 132 for securing the circuit board to and/or within the optical sleeve 105. For example, the guide holes 132 may each be configured to receive a guide column 112D and/or a fastener 102 at least partially therethrough. Various embodiments may employ a variety of techniques for securing the circuit board 130 to and/or within the optical sleeve 105.

Exemplary LED Packages

In example embodiments, the light module 100 comprises two or more LED packages 134. For example, in an example embodiment, at least one LED package 134 is mounted to a first side 138A of the circuit board 130 and at least one LED package 134 is mounted to a second side 138B of the circuit board 130. In an example embodiment, a plurality of LED packages 134 are mounted to each of the first and second sides 138A, 138B of the circuit board 130. In various embodiments, each LED package 134 is mounted to the circuit board 130 in electrical communication with a corresponding set of LED leads 144. In various embodiments, the plurality of LED packages 134 mounted to each of the first side 138A and the second side 138B of the circuit board 130 may be mounted in a predetermined pattern. In various embodiments, the predetermined pattern may be a series of aligned columns, a series of aligned rows, a series of offset columns, a series of offset rows, and/or the like. For example, as shown in FIGS. 5A and 5C, the predetermined pattern may be series of offset columns and/or a series of offset rows. In an example embodiment, the predetermined pattern of the LED packages 134 mounted to the first side 138A of the circuit board 130 is the same and/or a mirror pattern as the predetermined pattern of the LED packages 134 mounted to the second side 138B of the circuit board 130. In an example embodiment, the predetermined pattern of the LED packages 134 mounted to the first side 138A of the circuit board 130 is different from the predetermined pattern of the LED packages 134 mounted to the second side 138B of the circuit board 130.

In example embodiments, an LED package 134 comprises one or more LED chips, electrical contacts, and optionally phosphor (e.g., to cause the LED package to emit white light). The LED package 134 may further comprise encapsulant to protect the one or more LED chips, wire bonds, and the phosphor. In an example embodiment, the LED packages 134 may comprise one or more alternate current (AC) driven LEDs. In some embodiments, the LED package 134 may further comprise one or more optical elements. For example, the LED package 134 may comprise one or more primary optical elements. In an example embodiment, the one or more of the LED packages 134 may be configured to emit light of at least one of 2700K, 3000K, 3500K, 4000K, 5000K, 5700K, 6000K, 7000K, 7500K and/or other color temperatures, as appropriate for the application.

In example embodiments, the one or more LED packages 134 may be in electrical communication with driver circuitry 140 (e.g., via corresponding LED leads 144) such that the one or more LED packages 134 may be operated by the driver circuitry 140. For example, the driver circuitry 140 may provide a controlled electrical current to at least one of the LED packages 134. In example embodiments, the one or more LED packages 134 may be configured to provide light that varies in brightness, color temperature, CRI, and/or the like based on the current provided to the one or more LED packages 134 by the driver circuitry 140. For example, the driver circuitry may provide a particular current to an LED package 134 to cause the LED package 134 to provide light having particular light aspects or qualities. For example, the driver circuitry 140 may provide a pulsed signal to the LED package 134 (e.g., via the corresponding LED leads 144) that causes the LED package 134 to turn on and off and/or brighten and dim in accordance with a preprogrammed pattern such that the light emitted by the light module 100 simulates that of a flickering flame.

In example embodiments, the LED packages 134 may comprise one or more LED packages 134 that are configured to emit light other than "white" light. For example, the LED packages 134 may comprise one or more LED packages 134 configured to emit a red or amber light and/or the like.

Exemplary Driver Circuitry

In example embodiments, the driver circuitry 140 may be configured to provide a controlled electrical current to at least one of the LED packages 134 during operation of the light module 100 and/or flame lamp 200. In various embodiments, the driver circuitry 140 may comprise a circuit portion configured to convert AC voltage into DC voltage. In some embodiments, the driver circuitry 140 may comprise a circuit portion configured to control the current flowing through the one or more LED packages 134. In certain embodiments, the driver circuitry 140 may comprise a circuit portion configured to dim the one or more LED packages 134. In an example embodiment, the driver circuitry 140 may be configured to provide a particular current to one or more of the LED packages 134 to provide light having specific light aspects qualities (e.g., brightness, color temperature, CRI, and/or the like). For example, the driver circuitry 140 may be configured to drive one or more LED packages 134 such that the LED packages provide light having the desired light aspects or qualities. In various embodiments, the driver circuitry 140 may be configured to drive one or more LED packages 134 in accordance with a preprogrammed pattern. For example, the driver circuitry 140 may be configured to drive the one or more LED packages 134 such that various ones of the one or more LED packages 134 are turned on and/or off, brightened and/or dimmed, and/or the like such that the light emitted by the light module 100 and/or flame lamp simulates that of a flickering flame, for example. In various embodiments, the driver circuitry may be configured to turn the LED packages 134 on and/or off and/or brighten and/or dim the LED packages 134 individually or in pre-defined groups of LED packages 134. In various embodiments, additional circuit components may be present in the driver circuitry 140.

Similarly, in various embodiments, all or some of the circuit portions mentioned here may not be present in the driver circuitry 140. In some embodiments, circuit portions listed herein as separate circuit portions may be combined into one circuit portion. As should be appreciated, a variety of driver circuitry configurations are generally known and understood in the art and any of such may be employed in various embodiments as suitable for the intended application, without departing from the scope of the present invention.

FIG. 11 provides a block diagram of an example embodiment of driver circuitry 140. For example, the driver circuitry 140 receives electrical power (e.g., a current, AC line voltage, DC voltage from a DC power source, and/or the like). The driver circuitry 140 may then provide a controlled current to each LED package 134 via a corresponding LED lead 144. The driver circuitry 140 may comprise a processing element 37, memory 38, and/or other circuitry components 36. In various embodiments, the processing element 37 and/or memory 38 may be an integrated circuit. In example embodiments, the driver circuitry 140 may comprise a microcontroller unit (MCU). For example, the processing element 37 and/or memory 38 may be implemented as an MCU. In an example embodiment, the driver circuitry 140 may comprise a single integrated circuit. For example, the processing element 37 and/or memory 38 may be implemented as an integrated circuit.

In example embodiments, the driver circuitry 140 comprises one or more processing elements 37 (also referred to as processors, processing circuitry, processing device, and/or similar terms used herein interchangeably) that communicate with other elements within the driver circuitry 140. For example, the processing element(s) 37 may communicate with the memory element(s) 38, and/or components 36 of the driver circuitry 140 via direct electrical connection, a bus, and/or the like. For example, the processing element(s) 37 may be configured to operate the plurality of LED packages 134 such that LED packages 134 are turned on and/or off and/or dimmed and/or brightened individually and/or in groups such that the light emitted by the light module 100 and/or flame lamp 200 flickers. For example, the processing element 37 may be programmed (e.g., via executable instructions stored in memory 38 and/or the like) to turn the LED packages 134 on and/or off and/or dim and/or brighten the LED packages 134 individually and/or in groups in accordance with a preprogrammed pattern such that the light emitted by the light module 100 and/or flame lamp 200 flickers. For example, the processing element 37 may be programmed to provide a pulse-width modulation signal with a predetermined and/or predefined timing sequence to control the turning on and/or off and/or brightening and/or dimming of the LED packages 134.

As will be understood, the processing element 37 may be embodied in a number of different ways. For example, the processing element 37 may be embodied as one or more complex programmable logic devices (CPLDs), microprocessors, multi-core processors, co-processing entities, application-specific instruction-set processors (ASIPs), microcontrollers, and/or controllers. Further, the processing element 37 may be embodied as one or more other processing devices or circuitry. The term circuitry may refer to an entirely hardware embodiment or a combination of hardware and computer program products. Thus, the processing element 37 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 37 may be configured for a particular use or configured to execute instructions stored in volatile or non-volatile media or otherwise accessible to the processing element 37. As such, whether configured by hardware or computer program products, or by a combination thereof, the processing element 37 may be capable of performing steps or operations according to embodiments of the present invention when configured accordingly.

The memory element(s) 38 may be non-transitory and may include, for example, one or more volatile and/or non-volatile memories. In other words, for example, the memory 38 may be an electronic storage device (e.g., a computer readable storage medium) comprising gates configured to store data (e.g., bits) that may be retrievable by a machine (e.g., a computing device like the processing element 37). The memory 38 may be configured to store information, data, content, applications, instructions, or the like for enabling the driver circuitry 140 to carry out various functions in accordance with an example embodiment of the present invention. For example, the memory 38 could be configured to store instructions for execution by the processing element 37. For example, the executable instructions that cause the processing element 37 to operate (e.g., turn on and/or off, brighten and/or dim) the LED packages in accordance with the predetermined and/or predefined timing sequence may be stored in the memory 38.

Exemplary Optical Sleeve

In various embodiments, the light module 100 comprises an optical sleeve 105. In an example embodiment, the optical sleeve 105 is configured to condition the light emitted by the LED packages 134 mounted to a planar circuit board 130 such that light is emitted by the light module 100 at 200°-360° about the module axis 146 of the light module 100. For example, the optical sleeve 105 may be configured to condition the light emitted by the LED packages 134 mounted to a planer circuit board 130 such that the light is emitted by the light module 100 at approximately 360° about the module axis 146. For example, the optical sleeve 105 may define an interior and an exterior with the circuit board 130 mounted and/or secured within the interior of the optical sleeve 105 is emitted from the light module 100 by passing from the interior of the optical sleeve 105, through the optical sleeve 105, and to the exterior of the optical sleeve 105.

In various embodiments, the optical sleeve 105 comprises a plurality of optical columns 116, 126. In an example embodiment, each optical column 116, 126 corresponds to one LED package 134. For example, an optical column 116, 126 may be configured to condition light emitted by a corresponding one of the LED packages 134. In various embodiments, each optical column 116, 126 comprises a column surface 117, 127 and a light emitting surface 115, 125. The light 50 emitted by an LED package 134 is emitted from the light module 100 through the light emitting surface 115, 125 of an optical column 116, 126 corresponding to (e.g., disposed adjacent to) the LED package 134. For example, in an example embodiment, for each LED package 134, an optical column 116, 126 is positioned such that light 50 emitted by the LED package 134 passes through the corresponding optical column recess 118, 128 and propagates along the optical column 116, 126 (e.g., possibly via assistance by reflecting and/or refracting off of the inner wall of the column surface 117, 127) and exits the optical column 116, 126 via the light emitting surface 115, 125. In various embodiments, the column surface 117, 127 (and/or the inner surface of the column surface 117, 127) may be textured, irregular, roughened, have a sawtooth texture, and/or the like such that at least a portion of the light 50 incident on the column surface 117, 127 will be dispersed outward through the column surface 117, 127. The light 50 emitted through the light emitting surface 115, 125 propagates outward from the light module 100 generally perpendicular to the light emitting surface 115, 125 through which the light 50 was emitted. In various embodiments, the light emitting surface 115, 125 may be planar, convex, or concave, based on the application.

FIG. 10A provides a cross-section of the light module 100 taken perpendicular to the module axis 146 along the line A-A in FIG. 10. As can be seen in FIG. 10A, the in the cross-section of the light module 100, the light emitting surfaces 115, 125 define an ellipse 148. For example, each light emitting surface 115, 125 may have a profile such that, collectively, the profiles of the light emitting surfaces 115, 125 define an ellipse and/or elliptical cylinder about the circuit board 130. For example, the light emitting surfaces 115, 125 may be slanted, curved and/or planer surfaces at an angle to the corresponding column surfaces 117, 127 such that the light emitting surfaces 115, 125 define an elliptical cylinder about the light module 100. In an example embodiment, the elliptical cylinder is a circular cylinder. For example, in an example embodiment, in the cross-section of the light module 100, the light emitting surfaces 115, 125 define an ellipse 148 that is a circle. In an example embodiment, the axis of the cylinder defines and/or is the same as the module axis 146. In an example embodiment, the optical sleeve 105 may be, at least in part, an elliptical, circular, and/or multi-faceted cylinder, rather than comprising a plurality of optical columns 116, 126.

In an example embodiment, the optical sleeve 105 is made, at least in part, of translucent, transparent, semi-translucent, and/or semi-transparent plastic, glass, or other appropriate material.

In an example embodiment, the optical sleeve 105 comprises a first optical element 110 and a second optical element 120. In an example embodiment, the first optical element 110 and the second optical element 120 may be secured to one another about the circuit board 130 (e.g., such that the circuit board 130 is disposed between the first optical element 110 and the second optical element 120) to provide the optical sleeve 105. In an example embodiment, the first optical element 110 comprises one or more optical columns 116 that each correspond to an LED package 134 mounted to the first side 138A of the circuit board 130. In an example embodiment, the second optical element 120 comprises one or more optical columns 126 that each correspond to an LED package 134 mounted to the second side 138B of the circuit board 130.

In an example embodiment, the first optical element 110 comprises one or more engagement mechanisms 111. For example, the first optical element 110 may comprise four engagement mechanisms 111. For example, the engagement mechanisms 111 may be disposed at each corner of a planer element 113. The second optical element 120 may comprise one or more engagement mating mechanisms 121. For example, each engagement mating mechanism 121 may be configured to mate with a corresponding one of the engagement mechanisms 111. For example, the second optical element 120 may comprise four engagement mating mechanisms 121. For example, the engagement mating mechanisms 121 may be disposed at each corner of the planar element 123. In an example embodiment, the mating of the engagement mechanisms 111 by the engagement mating mechanisms 121 assists in the alignment of the first optical element 110 and the second optical element when the first and second optical elements 110, 120 are secured to one another to form the optical sleeve 105. In an example embodiment, the first and second optical elements 110, 120 may be secured to one another via fasteners 102 being inserted at least partially through the engagement elements 112B, 122B, 112C, 122C, as illustrated in FIG. 7.

In various embodiments, the first optical element 110 comprises a planar element 113 and a base portion 114. For example, the optical columns 116 may extend outward from the planar element 113. In an example embodiment, the optical columns 116 extend perpendicularly outward from the planer element 113. In various embodiments, the planar element 113 may be directly adjacent to and/or in physical contact with a surface of the circuit board 130. The base portion 114 may curve and/or otherwise extend away from the surface of the circuit board 130 (e.g., the driver portion 136 of the circuit board 130) to provide room for the driver circuitry 140. In an example embodiment, the first optical element 110 comprises a transverse planar element 119 that connects the planar element 113 and the base portion 114. Similarly, in various embodiments, the second optical element 120 comprises a planar element 123 and a base portion 124. For example, the optical columns 126 may extend outward from the planar element 123. In an example embodiment, the optical columns 126 extend perpendicularly outward from the planer element 123. In various embodiments, the planar element 123 may be directly adjacent to and/or in physical contact with a surface of the circuit board 130. The base portion 124 may curve and/or otherwise extend away from the surface of the circuit board 130 (e.g., the driver portion 136 of the circuit board 130) to provide room for the driver circuitry 140. In an example embodiment, the second optical element 120 comprises a transverse planar element 219 that connects the planar element 123 and the base portion 124.

Exemplary Method of Manufacturing a Flame Lamp

FIG. 12 provides a flowchart illustrating processes and procedures for manufacturing a flame lamp 200, according to an example embodiment. Starting at block 2, the LED packages 134 and driver circuitry 140 are mounted to the circuit board 130. For example, one or more LED packages 134 may be mounted to a first side 138A of the circuit board 130 in a predetermined and/or predefined pattern such that each LED package 134 is in electrical communication with a corresponding set of LED leads 144. In an example embodiment, one or more LED packages 134 may be mounted to a second side 138B of the circuit board 130 in a predetermined and/or predefined pattern such that each LED package 134 is in electrical communication with a corresponding set of LED leads 144. In an example embodiment, the driver circuitry 140 is mounted to the driver portion 136 of the circuit board 130 and the first and/or second sides 138A, 138B of the circuit board 130.

At block 4, the first and second optical elements 110, 120 may be secured about the circuit board 130. For example, a guide hole 132 may be placed over a corresponding guide column 112*d* and a fastener 102 may be secured at least partially within the engagement elements 112*c*, 122*c*, guide column 112*d*, and guide hole 132. Additionally, a fastener 102 may be secured at least partially within engagement elements 112*b*, 122*b*. As should be understood, various techniques may be used to secure the first and second optical elements 110, 120 about the circuit board 130 to form the optical sleeve 105.

At block 6, the light module 100 may be electrically and mechanically secured within the base assembly 250. For example, the electrical leads 142 may be secured to the appropriate connection points of the connection facilitator 230. For example, fasteners 202 may be secured at least partially within the engagement elements 112A, 122A and the corresponding fastener receivers 222. As should be understood, various techniques may be used to electrically and mechanically secure the light module 100 within the base assembly 250.

At block 8, the envelope 210 is secured to the base assembly 250 to enclose the light module 100 within the flame lamp 200. For example, the envelope 210 may be secured to the base assembly 250 such that the light module 100 is enclosed within an interior of the flame lamp 200 defined by the envelope 210 and the base assembly 250. For example, the envelope 210 may be secured to the base assembly 250 via rotating the envelope 210 with respect to the base assembly 250 such that threads 214 mate with corresponding threads 224 to secure the envelope 210 to the base assembly 250. As should be understood, various techniques may be used to secure the envelope 210 to the base assembly 250.

CONCLUSION

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A light module comprising:
- a planar circuit board having a first side and a second side opposite the first side;
- at least a first LED package located on the first side of the circuit board;
- at least a second LED package located on the second side of the circuit board; and
- an optical sleeve having an exterior and an interior, wherein:
  - the circuit board is located within the interior of the optical sleeve, and
  - the exterior of the optical sleeve comprises at least two optical columns each having a light emitting surface, each of the at least two light emitting surfaces being opposite another of the at least two light emitting surfaces, with the planar circuit board intermediate each of the at least two light emitting surfaces.

2. The light module of claim 1, wherein each optical column corresponds to one of the first and second LED packages.

3. The light module of claim 2, wherein each of the at least two light emitting surfaces has a profile such that one or more profiles of one or more light emitting surfaces define an ellipse in a cross-section of the light module taken perpendicular to a module axis.

4. The light module of claim 3, wherein the ellipse is a circle.

5. The light module of claim 1, wherein the optical sleeve comprises a first optical element and a second optical element.

6. The light module of claim 5, wherein the first optical element comprises optical columns corresponding to LED packages mounted to the first side of the circuit board and the second optical element comprises optical columns corresponding to LED packages mounted to the second side of the circuit board.

7. The light module of claim 5, wherein the first optical element comprises one or more engagement elements and the second optical element comprises one or more engagement mating elements each configured to engage a corresponding one of the one or more engagement elements.

8. The light module of claim 1, further comprising driver circuitry mounted to a driver portion of the circuit board.

9. The light module of claim 8, wherein the driver circuitry comprises a processing element.

10. The light module of claim 9, wherein the processing module is programmed to cause the driver circuitry to provide a pulsing signal to the plurality of LED packages.

11. The light module of claim 10, wherein the pulsing signal causes the plurality of LED packages to brighten and dim to simulate the optical appearance of a flame.

12. The light module of claim 10, wherein the pulsing signal causes the plurality of LED packages to turn on and off to simulate the optical appearance of a flame.

13. The light module of claim 12, wherein the driver circuitry is configured to control the LED packages or groupings of LED packages independently.

14. A flame lamp comprising:
- a light module comprising:
  - a planar circuit board having a first side and a second side opposite the first side;
  - at least a first LED package located on the first side of the circuit board;
  - at least a second LED package located on the second side of the circuit board; and
  - an optical sleeve having an exterior and an interior, wherein:
    - the circuit board is located within the interior of the optical sleeve, and
    - the exterior of the optical sleeve comprises at least two optical columns each having a light emitting surface, each of the at least two light emitting surfaces being opposite another of the at least two light emitting surfaces, with the planar circuit board intermediate each of the at least two light emitting surfaces;
- an envelope; and
- a base assembly,
- wherein the light module is enclosed within the envelope and the base assembly.

15. The flame lamp of claim 14, wherein:
- each optical column corresponds to one of the first and second LED packages;
- each of the at least two light emitting surfaces has a profile such that one or more profiles of one or more light emitting surfaces define an ellipse in a cross-section of the light module taken perpendicular to a module axis; and
- the ellipse is a circle.

16. The flame lamp of claim 14, wherein the base assembly comprises a base cap configured to be electrically and mechanically secured into a socket.

17. The flame lamp of claim 14, further comprising driver circuitry mounted to a driver portion of the circuit board, the driver circuitry comprising a processing element, the processing element being programmed to cause the driver circuitry to provide a pulsing signal to the first and second LED packages.

18. The flame lamp of claim 17, wherein the pulsing signal causes the first and second LED packages to simulate the optical appearance of a flame by causing at least one of (a) the first and second LED packages to brighten and dim in a predetermined sequence or (b) the first and second LED packages to turn on and off in a predetermined sequence.

19. The flame lamp of claim 18, wherein the driver circuitry is configured to control the first and second LED packages independently.

20. The flame lamp of claim 17, wherein the base assembly comprises a power supply compartment for receiving a power supply therein such that the power supply received within the power supply compartment is electrically connected to the driver circuitry.

* * * * *